United States Patent [19]

Dyer et al.

[11] Patent Number: 5,069,251

[45] Date of Patent: Dec. 3, 1991

[54] FRICTIONLESS PLATE VALVE

[75] Inventors: Gerald P. Dyer, Enfield; Brian G. Donnelly, Suffield, both of Conn.

[73] Assignee: United Technologies Corporation, Hartford, Conn.

[21] Appl. No.: 604,385

[22] Filed: Oct. 25, 1990

Related U.S. Application Data

[63] Continuation of Ser. No. 372,796, Jun. 28, 1989, abandoned.

[51] Int. Cl.[5] ..... F15B 13/04

[52] U.S. Cl. ..... 137/625.25; 251/337

[58] Field of Search ..... 137/625.25; 251/337

[56] References Cited

U.S. PATENT DOCUMENTS

| | | | |
|---|---|---|---|
| 2,905,195 | 9/1959 | Lucien | 137/625.65 |
| 3,103,233 | 9/1963 | Wulf | 137/625.25 |
| 3,530,893 | 9/1970 | Masuda | 137/625.25 |
| 3,563,271 | 2/1971 | Marumo et al. | 137/625.25 |
| 4,609,012 | 2/1986 | Shelton | 137/625.25 X |

OTHER PUBLICATIONS

J. F. Blackburn, G. Reethof and J. L. Shearer, *Fluid Power Control*, pp. 238–275 and 410–417, 1960.

*Primary Examiner*—Gerald A. Michalsky

[57] ABSTRACT

A plate valve comprises a first and third plate which enclose a second plate, the second plate including a metering element having a lesser thickness than the second plate such that the metering element does not contact either of the first or third plates. The valve element is disposed within the second plate such that the valve element stokes without contacting the first and third plate regardless of the fluid pressure of the fluid being metered. The valve element is suspended by a pair of arms arranged perpendicularly to the flow of the fluid being supplied to the valve to be metered thereby.

13 Claims, 1 Drawing Sheet

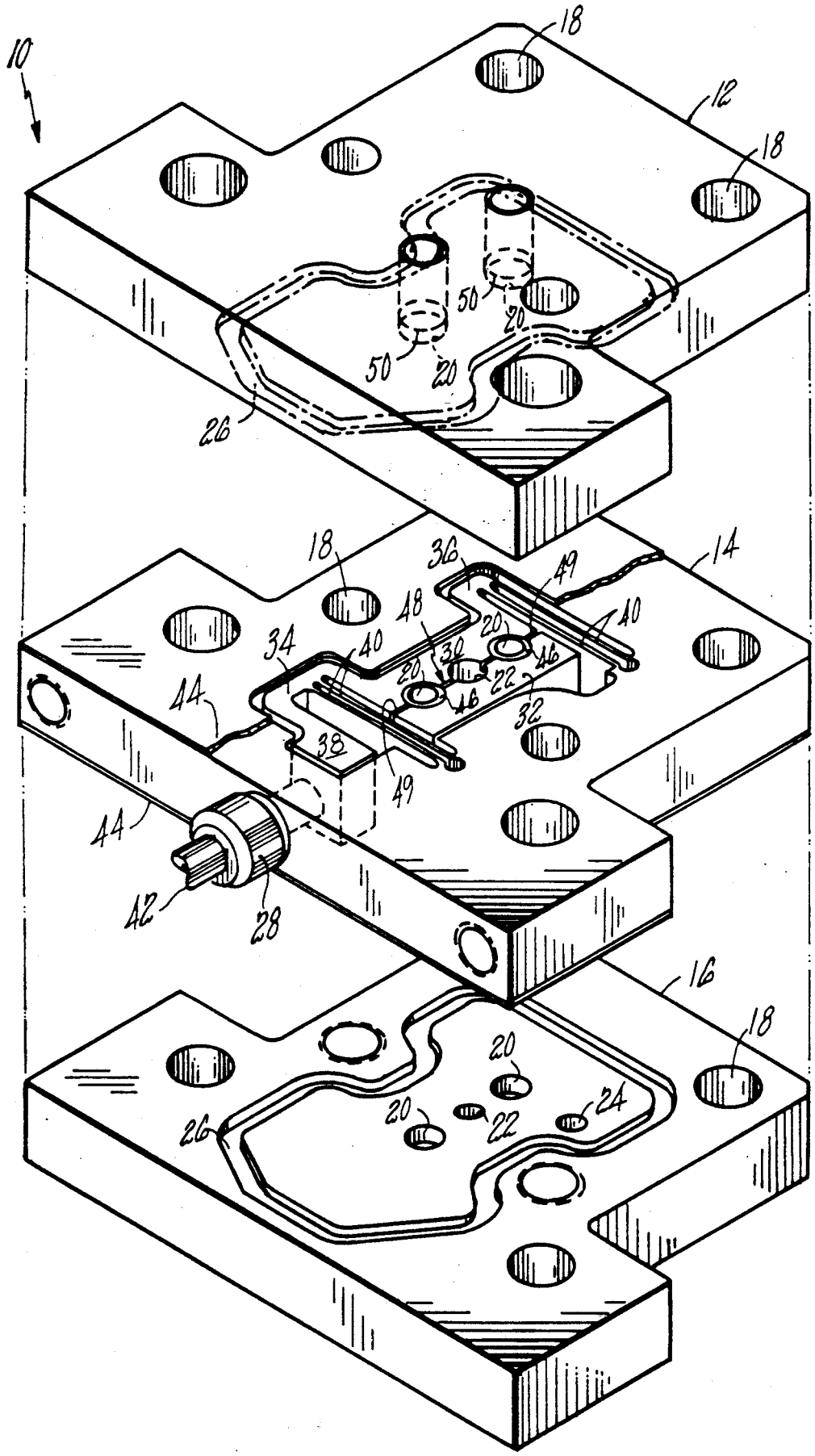
10
18
12
18
50
20
50
20
26
18
36
49
14
48
20
40
34
40
30
46
20
22
44
46
32
38
49
44
42
28
16
18
20
20
22
24
26

FRICTIONLESS PLATE VALVE

This is a continuation of application Ser. No. 07/372,796, filed June 28, 1989, now abandoned.

TECHNICAL FIELD

This invention relates to electrohydraulic valves.

BACKGROUND ART

Two-stage electrohydraulic valves (EHV) typically use a motor to position a flapper. The flapper, in turn, directs hydraulic fluid (which acts as an hydraulic amplifier) to either end of a valve which meters correspondingly larger flows of fluid. In this manner, a relatively small motor may position a valve which meters relatively large flows of hydraulic fluid.

Some two-stage EHV's are relatively unreliable and have high leakage rates. As a result, in some applications, a one-stage EHV, in which a metering valve is directly positioned by a motor, is required. A typical one-stage EHV has a spool valve which is directly driven by a force motor. The output of the motor is balanced by the reactional force of a spring attached to the spool valve. Since the one-stage EHV has no hydraulic amplifier, as in a two-stage EHV, it is essential that the valve encounter low friction forces to avoid hysteresis and threshold friction.

One draw back of a one-stage EHV is that a relatively large motor is required to overcome hysteresis and threshold friction. In many applications, such as aircraft fuel controls, larger motors are undesirable.

Spool valves typically have an unacceptable amount of friction inherent in their design resulting from the lack of spool straightness, the taper of the valve housing, or pressure induced side loading of the spool.

Plate valves are known to be used as part of an EHV. Typically, a force motor positions a metering plate. In a suspension type plate valve, the metering plate is suspended by a pair of arms that are disposed in a generally perpendicular manner to the motion of the valve plate. The suspension arms are also disposed, in the null position, in parallel to the fluid pressure force acting upon the metering plate. The fluid pressure causes the metering plate to open in one direction or the other, depending on the deflection of the metering plate relative to its suspension arms by the fluid pressure force acting upon the metering plate. Once the suspension arms are pushed past parallel to the direction of the fluid pressure force, the fluid pressure force pushes the metering plate even further past parallel thereby tending to open the valve even further. The unwanted opening caused by the fluid pressure tends to provide a nonlinear output relative to the input of the force motor.

Another type of plate valve disposes a metering plate between two blocks separated by a pair of spacers. The thickness of the spacers is slightly greater than the thickness of the metering plate, allowing the metering plate to slide therebetween. Metering orifices are placed in parallel, above and below the metering plate, and each block has a set of pressure and return cavities, to grossly pressure balance the plate between the two blocks to reduce contact between the metering plate and the blocks. However, manufacturing tolerances on the areas of the pressure and return cavities result in a pressure imbalance on the metering plate, and the resulting side load causes a friction force due to metal to metal contact of the metering plate and bearing and sealing surfaces. Such a valve may have friction levels as low as spool valves. However, as above, such friction forces are still too high for certain applications.

Some plate valves, in which very low friction is desired, utilize holes which pass through the metering plate. The holes are connected to the pressure supply. The fluid pressure force of the supplied fluid tends to center the metering plate between the blocks. However, the placement of the holes is critical and the amount of leakage is excessive.

DISCLOSURE OF INVENTION

It is an object of the invention to provide a simple one-stage valve which encounters a minimum of friction force.

It is the further object of the invention to provide a one-stage valve which provides a linear output regardless of the fluid pressure of the supplied hydraulic fluid.

According to the invention, a plate having a metering element disposed therein is provided. The metering element is suspended within the plate such that the metering elements strokes without protruding above the surfaces of the plate regardless of the fluid pressure of the fluid being metered. The plate valve is suspended by a pair of arms arranged perpendicularly to the flow of the fluid being metered.

According further to the invention, a first and third plate enclose a second plate, the second plate including a metering element having a lesser thickness than the second plate such that the metering element does not contact either of the first or third plates. The valve element is disposed within the second plate such that the valve element strokes without contacting the first and third plate regardless of the fluid pressure of the fluid being metered. The valve element is suspended by a pair of arms arranged perpendicularly to the flow of the fluid being supplied to the valve to be metered thereby. The arms have a very high spring rate in the direction of the flow of fluid being supplied.

The foregoing and other features and advantages of the present invention will become more apparent from the following description and accompanying drawing.

BRIEF DESCRIPTION OF DRAWING

The FIGURE is a schematic, exploded view, of an embodiment of the valve of the invention.

BEST MODE FOR CARRYING OUT THE INVENTION

Referring to the drawing, a plate valve 10 embodying the concepts of the invention is shown. The valve is comprised of a first plate 12, a second plate 14, and a third plate 16. The plates each have a roughly T-shaped body and are similarly sized and dimensioned.

Each plate has six bored holes 18 which are used to attach and align each plate relative to each other plate by suitable means such as bolts (not shown). Each plate has two metering holes 20 bored therethrough. The second plate 14 and the third plate 16 each have a supply hole 22. The supply holes are arranged so that fluid may flow from the supply hole in the third plate 16 to the supply hole in the second plate 14 as will be discussed infra. The third plate has a drain hole 24. The first and third plates have a groove 26 to receive a gasket (not shown) for sealing the plate valve 10 against leakage.

The second plate 14 has a torque-motor coupling 28 and a valve element 30. The valve element has a body portion 32, a first arm 34, a second arm 36, an attachment block 38 depending from the first arm, and four flexures 40. The coupling 28 is designed to sealingly receive the shaft 42 of a force motor (not shown). The second plate 14 has a thin coating 44 deposited on both sides thereof so that the valve element 30 does not touch the first plate 12 or the third plate 16 during operation. The clearance between the valve element and the first and third plates is small to minimize leakage but not so small that contact between the plates and the valve element occurs.

The supply hole 22 is disposed within the valve element 30 for admitting fluid thereto. An impervious sleeve 46 is disposed within each metering hole 20 for metering fluid as will be discussed infra. The body 30 has a slot 48 machined across the top side and an identically placed and dimensioned slot (not shown) machined across the bottom side thereof. Each slot passes through the metering holes and the supply hole so that a portion 49 of each slot extends to either edge of the body portion 32. The plates 12, 14, 16, and the sleeves 46 may be made of any suitable material but a CPM 10V tool steel, manufactured by Crucible Materials Corporation of Pittsburgh, Pa., is preferred. The coating 44 may be made of any suitable material such as nickel or gold leaf.

To construct the valve, the sleeves 46 are pressed into the metering holes 20 in the second plate 14 and machined flush to the surface. A pair of plugs 50 are pressed into the metering holes 20 in the first plate 12. The plugs 50 do not extend to the lower surface of the first plate 12, as will be discussed infra. The gaskets (not shown) are placed in the grooves 26 and the three plates are bolted together via the six holes 18 in each plate. The shaft 42 passes through the coupling 28 and is threaded into the attachment block 38.

In operation, fluid flows through the supply hole 22 in the third plate 16 to the supply hole 22 in the second plate 14 (and the valve element 32). The fluid then flows through the groove 48 in the top of the valve element and the groove (not shown) in the bottom of the valve element. Fluid does not flow through the metering holes until the valve element is stroked by the shaft 42 from the null position because the sleeves 46 block the flow. The shaft is moved by the force motor (not shown) to position the valve element 32. Fluid is then free to flow to one of the respective metering holes 20 in the third plate 16 (depending on the direction of stroke of the valve element) from the groove (not shown) in the bottom of the valve element. Similarly, the fluid may flow through the groove 48 in the top of the element, into a respective metering hole 20 (which is not totally plugged to allow such flow) in the first plate 12, through a respective sleeve 46 in the valve element, and into the respective metering hole 20 in the third plate 16.

As fluid flows through one of the metering holes in the third plate 16, fluid may return to the valve via the other metering hole 20. A first portion of this fluid flows through the portion 49 of the groove in the bottom of the metering element and then to the drain hole 24. A second portion of the fluid flows through the sleeve 46 which aligns with the other metering hole, into the metering hole in the first plate 12 and through the portion 49 of the groove in the top of the metering element and then to the drain hole 24.

By having two grooves, the amount of metered flow is doubled. Additionally, the fluid is provided on the top side and bottom side of the valve element to pressure balance the valve element, thereby minimizing any side loading thereon. By allowing the flow to pass into the metering holes 20 in the first plate 12 and through the sleeves (and portions 49 of the groove 48), exterior plumbing to merge the two flows is kept to a minimum. Any leakage between the plates flows to the drain hole 24.

The flexures 40 are disposed perpendicularly to the direction of the fluid flow (i.e. through the supply hole in the third plate 16) to minimize deflection of the valve element in the direction of the fluid flow. The flexures deflect a minimum amount in the direction of the fluid flow so that any residual side loading of the valve due to the fluid pressure force of the fluid being metered is reacted by the flexures. The resulting deflection of the valve element is less than the clearance between the valve element and the first and third plates. As a result, surface to surface contact between the valve element and the first and third plates is minimized during operation. The output force of the force motor is balanced by the spring force of the flexures supporting the valve element, so that, coupled with the minimal friction encountered by the valve element, the displacement of the valve element is linearly proportional to the input of the force motor.

Although the invention has been shown and described with respect to a best mode embodiment thereof. It should be understood by those skilled in the art that the foregoing and various other changes, omissions, and additions in form and detail thereof may be made therein without departing from the spirit and scope of the invention.

We claim:

1. A plate valve comprising:

a plate having a first and second side and a given thickness;

a valve element, disposed within said plate, for stroking to meter a fluid flow into said element, said element having a first and second side and having a lesser thickness than said plate, a supply passage passing through said element, at least one metering stop disposed within said element, and a first metering groove disposed within said first side of said element, said metering groove extending from said passage to said stop; and a flexure, for attaching said plate to said element by providing a first attachment between said flexure and said element and by providing a second attachment between said flexure and said plate, wherein a direction from said first attachment to said second attachment is substantially perpendicular to a direction of said fluid flow.

2. The plate valve of claim 1 wherein said valve element further comprises:

a second metering groove disposed within said second side of said element, said second metering groove extending from said passage to said stop, said first and second metering grooves being located to pressure balance said metering element within said plate.

3. The plate valve of claim 1 wherein said valve element further comprises:

a first drain groove disposed within said first side of said element and extending from said stop to an edge of said element.

4. The plate valve of claim 3 wherein said valve element further comprises:

a second drain groove disposed within said second side of said element and extending from said stop to an edge of said element said first and second drain grooves being located to pressure balance said metering element within said plate.

5. A plate valve comprising:

a first plate;

a third plate;

a second plate being disposed between said first and third plates, said second plate having a given thickness;

a valve element, disposed within said plate, for stroking to meter a fluid flow into said element, said element having a first and second side and having a lesser thickness than said plate, a supply passage passing through said element, at least one metering stop disposed within said element, and a first metering groove disposed within said first side of said element, said metering groove extending from said passage to said stop; and, a flexure, for attaching said second plate to said element by providing a first attachment between said flexure and said element and by providing a second attachment between said flexure and said second plate, wherein a direction from said first attachment to said second attachment is substantially perpendicular to a direction of said fluid flow.

6. The plate valve of claim 5 wherein said valve element further comprises:

a second metering groove disposed within said second side of said element, said second metering groove extending from said first passage to said stop, said first and second metering grooves being located to pressure balance said metering element within said plate.

7. The plate valve of claim 5 further comprising:

said third plate having a second supply passage and a metering passage, said second supply passage aligning with said first supply passage such that said fluid flows from said first passage to said second passage, said metering passage aligning with said groove such that motion of said element along said axis meters fluid through said groove to said metering passage.

8. A plate valve comprising:

a first plate;

a third plate;

a second plate being disposed between said first and third plates, said second plate having a given thickness;

a valve element, for stroking to meter a fluid flow into said element, having a lesser thickness than said second plate, and being disposed within said second plate, and having a first supply passage passing through said element, at least one metering stop disposed within said element, a first metering groove disposed within said first side of said element, said metering groove extending from said first passage to said stop, and a second metering groove disposed within said second side of said element, said second metering groove extending from said first passage to said stop, said first and second metering grooves being located to pressure balance said metering element within said plate;

a flexure, for attaching said second plate to said element by providing a first attachment between said flexure and said element and by providing a second attachment between said flexure and said second plate, wherein a direction from said first attachment to said second attachment is substantially perpendicular to a direction of said fluid flow;

said third plate having a second supply passage and a metering passage, said second supply passage aligning with said first supply passage such that as said fluid flows from said first passage to said second passage, said metering passage aligning with said groove such that motion of said element along said axis meters fluid through said groove to said metering passage; and said first plate having a second metering passage, said second metering passage aligning with said groove such that motion of said element within said plate members fluid through said groove to said second metering passage.

9. The plate valve of claim 8 wherein said stops comprise:

hollow sleeves passing through said element, said stops aligning with said second metering passage and said first passages such that fluid passing to said second metering passage from said groove passes through said sleeve to said first passage.

10. A plate valve comprising:

a first plate;

a third plate;

a second plate being disposed between said first and third plates, said second plate having a given thickness;

a valve element, for stroking to meter a fluid flow into said element, having a lesser thickness than said second plate, and being disposed within said second plate, and having a first supply passage passing through said element, a first and second metering stop disposed within said element, a first metering groove disposed within said first side of said element, said metering groove extending from said first passage to said first and second stop, and a second metering groove disposed within said second side of said element, said second metering groove extending from said first passage to said first and second stops, said first and second metering grooves being located to pressure balance said metering element within said plate; and, a flexure, for attaching said second plate to said element by providing a first attachment between said flexure and said element and by providing a second attachment between said flexure and said second plate, wherein a direction from said first attachment to said second attachment is substantially perpendicular to direction of said fluid flow;

said third plate having a second supply passage and a first and second metering passage, said second supply passage aligning with said first supply passage such that as said fluid flows from said first passage to said second passage, said first and second metering passages align with said first metering groove such that stroking of said element meters fluid through said first metering groove to one of said first and second metering passages; and said first plate having a third and fourth metering passage, said third and fourth metering passages aligning with said second metering groove such that the stroking of said element meters fluid through said second metering groove to one of said third and fourth metering passages.

11. The plate valve of claim 10 wherein said stops comprise:

hollow sleeves passing through said element, said stops aligning with said third and fourth metering passages such that fluid passing to said second and third metering passages from said second metering groove passes through said sleeves to said first and second passages.

12. The plate valve of claim 11 wherein said valve element further comprises:

a first pair of drain grooves disposed within said first ride of said element, each of said grooves extending from a stop to an edge of said element.

13. The plate valve of claim 12 wherein said valve element further comprises:

a second pair of drain groove disposed within said second side of said element, each of said grooves extending from a stop to an edge of said element said first pair of drain grooves and said second pair of drain grooves being located to pressure balance said metering element within said plate.

* * * * *

UNITED STATES PATENT AND TRADEMARK OFFICE

CERTIFICATE OF CORRECTION

PATENT NO. : 5,069,251

DATED : December 3, 1991

INVENTOR(S) : Gerald P. Dyer and Brian G. Donnelly

It is certified that error appears in the above-identified patent and that said Letters Patent is hereby corrected as shown below:

IN THE ABSTRACT

Line 8, "stokes" should be --strokes--

IN THE CLAIMS

Claim 1, Column 4, Line 36, after the second "and", --having-- should be inserted

Signed and Sealed this

Third Day of August, 1993

*Attest:*

*Attesting Officer*

Michael K. Kirk

MICHAEL K. KIRK

*Acting Commissioner of Patents and Trademarks*